United States Patent [19]

Pro

[11] Patent Number: 4,937,502

[45] Date of Patent: Jun. 26, 1990

[54] ELECTRONIC BALLAST

[75] Inventor: Stan Pro, Van Nuys, Calif.

[73] Assignee: Day-Ray Products, Inc., South Pasadena, Calif.

[21] Appl. No.: 204,695

[22] Filed: Jun. 9, 1988

[51] Int. Cl.[5] ..... H05B 37/02; H05B 39/04; H05B 39/00; G05F 1/00

[52] U.S. Cl. ..... 315/209 R; 315/205; 315/210; 315/291; 315/227 R; 315/DIG. 5; 315/DIG. 4; 315/DIG. 7

[58] Field of Search ..... 315/227 R, DIG. 5, DIG. 4, 315/DIG. 7, 205, 291, 209 R, 210

[56] References Cited

U.S. PATENT DOCUMENTS

| | | | |
|---|---|---|---|
| 2,507,101 | 5/1950 | Hall | 315/247 |
| 2,507,171 | 5/1950 | Hall | 315/247 |
| 2,961,579 | 11/1960 | Roney et al. | 315/170 |
| 3,125,705 | 3/1964 | Feinberg et al. | 315/DIG. 5 |
| 3,991,344 | 11/1976 | Tabor | 315/247 |
| 4,082,981 | 4/1978 | Morton et al. | 315/DIG. 5 |
| 4,096,410 | 6/1978 | Alley | 315/276 |
| 4,251,752 | 2/1981 | Stolz | 315/206 |
| 4,277,726 | 7/1981 | Burke | 315/DIG. 5 |
| 4,415,838 | 11/1983 | Houkes | 315/248 |
| 4,469,988 | 9/1984 | Cronin | 315/DIG. 5 |
| 4,523,128 | 6/1985 | Stamm et al. | 315/247 |
| 4,609,852 | 9/1986 | Perper | 315/276 |
| 4,613,792 | 9/1986 | Kroessler | 315/227 R |
| 4,686,427 | 8/1987 | Burke | 315/DIG. 4 |

OTHER PUBLICATIONS

"Day Ray Aviation Type Ballasts for Fluorescent Lamps Ratings & Data" published before Invention of applicant.

"Electronic Ballast Data Sheet Lighting" Avtech, published before Invention of applicant.

Official Gazette, Nov. 19, 1985, pp. 1391–1392.

Official Gazette, Apr. 2, 1985, p. 399.

*Primary Examiner*—Eugene R. LaRoche

*Assistant Examiner*—Michael Shingleton

*Attorney, Agent, or Firm*—Christie, Parker & Hale

[57] ABSTRACT

An electronic ballast circuit is provided for starting, operating and controlling the brightness of one or more fluorescent lamps. The brightness of the lamps is controlled over the full range of brightness from zero to full-rated power. The circuit power factor is controllable, and is preferably operated at a relatively high leading power factor. The circuit includes a capacitive ballast working in conjunction with a gapped transformer so as to provide the high leading power factor while, at the same time, maintaining stable and uniform brightness of the lamps. A power field effect transistor is utilized to function as a current stabilizer in conjunction with the capacitive ballast and gapped transformer. The system incorporates a dimming control circuit for increasing and decreasing the brightness of the lamps.

11 Claims, 1 Drawing Sheet

ELECTRONIC BALLAST

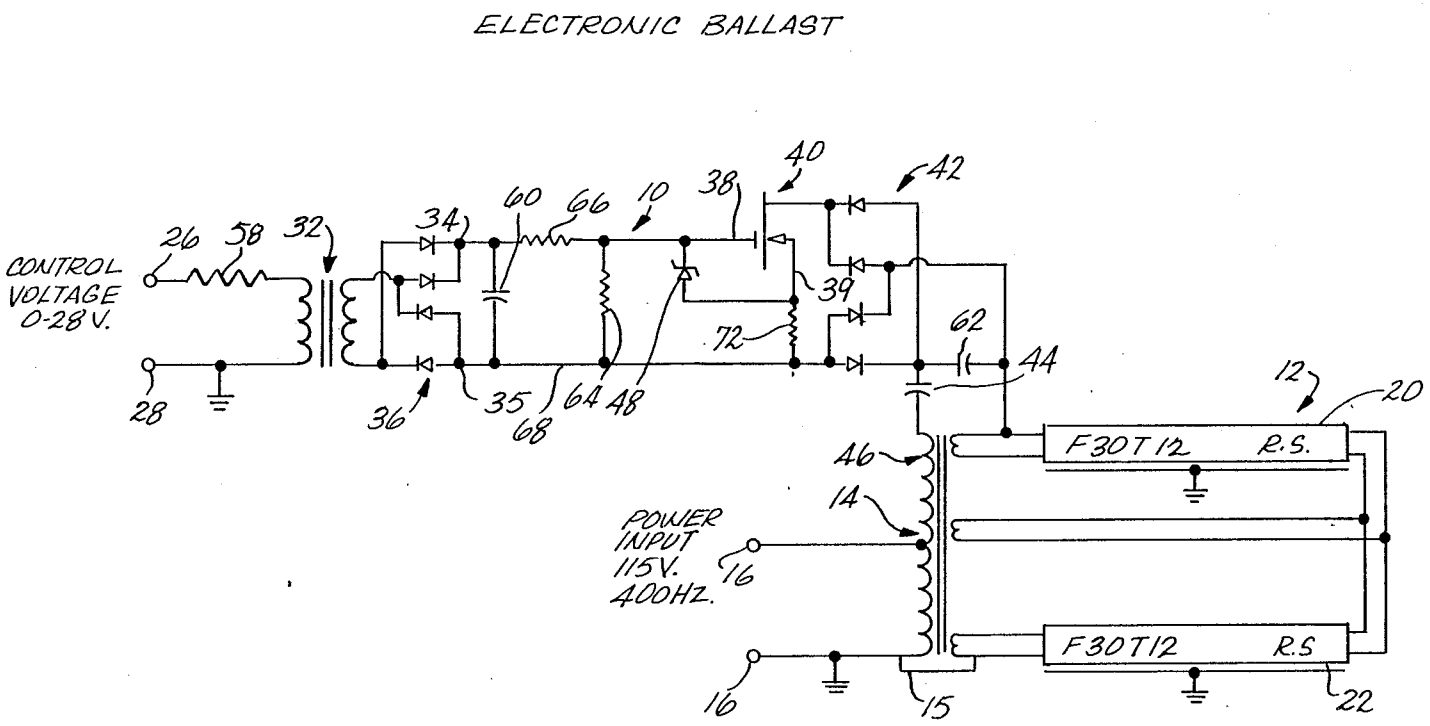
ELECTRONIC BALLAST
F30T12
R.S.
F30T12
R.S.
POWER INPUT 115V. 400HZ.
CONTROL VOLTAGE 0-28V.

ELECTRONIC BALLAST

BACKGROUND OF THE INVENTION

1. Field of the Invention

The present invention relates generally to the field of ballast circuits for fluorescent lamps. The invention specified relates particularly to an electronic fluorescent lamp ballast circuit using a capacitive element providing full range dimming while using a minimum number of components for reliability and having capability for operating at a high leading power factor.

2. Description of the Prior Art

Fluorescent lamps have a negative resistance characteristic once the gas in the lamp is ionized. This means that as its current begins to increase through the lamp, the resistance of the lamp decreases. This resistance decrease causes the current to further increase so that, unless some current-limiting ballast is provided, the lamp will be destroyed.

Thus, a ballast system is required which will enable the lamp to operate at a sufficiently high current for proper illumination, but will prevent the current from increasing to a level at which the lamp will destroy itself. In addition, a fluorescent lamp exhibits a very high effective resistance until the gas within the lamp ionizes, at which time a much lower resistance is presented. For that reason, the fluorescent lamp requires a high starting voltage in order that the lamp may be ignited.

For many years, iron-core transformer ballast systems have been utilized. Such designs were the only economical type available which were capable of providing a high starting voltage and, at the same time, being capable of limiting the operating current to an appropriate level. Such iron-core ballast circuits were used extensively despite several undesirable characteristics, including low power efficiency, an audible buzz and high weight.

There have been a number of attempts to improve the power efficiency of fluorescent lamp ballast systems in general, and such attempts have led to the provision of solid-state high-frequency electronic ballast systems. High frequency is desired because both the ballast system and the fluorescent lamp themselves are more efficient at frequencies at or above 400 Hz. Relatively recently small high-frequency solid-state ballasts have become available which are capable of being operated in conjunction with individual fluorescent lamp fixtures. These more recent solid-state ballast systems have the advantage over the prior-art iron-core ballast in that they are smaller size, lower weight, have virtually no audible noise and increased power efficiency.

Problems encountered with prior-art solid-state ballast systems are that, after the lamp has reached its ionization state, it exhibits negative resistance characteristics. This means that its resistance varies inversely with applied power or current. This negative characteristic is normally more easily controlled by iron-core transformers than by solid-state circuitry. This is because most of the appropriate solid-state circuits are constant voltage output devices which cannot accommodate the extreme reduction in the effective resistance of the fluorescent lamp when its gas ionizes.

The solid-state ballast system of the present invention, however, as will be described, overcomes these problems by providing a system utilizing a power circuit and a control circuit. The power circuit includes a gapped power transformer, which is connected between a 400 Hz source of electric power and the fluorescent lamp. The control circuit includes a power field effect transistor connected in an electrical circuit relationship with a ballast capacitor. Control voltages are applied to the input terminals of the control circuit for providing the dimming and brightening control signal for controlling the brightness of the fluorescent lamp or lamps, which are part of the circuit.

A second major problem encountered in the use of solid-state ballast system in the prior art, and one that has not been adequately solved prior to the present invention, is that of power factor. Power factor is the ratio of real power to reactive volt amperes. A high or leading power factor in excess of 75% is generally desirable in fluorescent light application for reasonable power efficiency. The present invention provides a leading power factor while at the same time offering stable light output throughout the dimming range.

SUMMARY OF THE INVENTION

The ballast system of the present invention is particularly applicable to utilization in ballast circuits for fluorescent lights utilized in aircraft applications. The preferred embodiment of the present invention is characterized by low weight, a high standard of electrical compatibility with fluorescent lamps, a leading power factor, and low electromagnetic and radio-frequency interference. The ballast of the circuit of the present embodiment is characterized by a leading power factor, which is generally considered to be desirable by aircraft manufacturers. The circuit is designed, however, so that the desired parameters of the circuit can be changed in alternate embodiments to provide a leading, unity or lagging power factor.

The circuit of the present invention is designed to operate with power input of 115 volts, 400 Hz and a control input of 0 to 28 volts, 400 Hz. Conventional electronic ballast designs rely heavily on high frequency as a means of achieving miniaturization and thereby weight reduction. Such techniques, however, result in electronic interference which must be removed by filtering circuits. The present invention eliminates the need for high-frequency operation and, thus, the need for filtering devices resulting in the provision of an extremely efficient and simple circuit design.

The preferred embodiment of the present invention operates as a dual lamp ballast operating the lamps in series thereby providing weight and efficiency savings. A series ballast requires only 60% more open circuit voltage than a single lamp ballast. Further, a shunt capacitor, often used to additionally reduce open circuit voltage requirements, is avoided to prevent uneven dimming at low intensity.

The present invention provides a ballast circuit for fluorescent lamps comprising at least one fluorescent lamp and a power circuit in electrical circuit relationship with the lamp, wherein the power circuit includes a power transformer having a gapped core. The ballast circuit also includes an electronic control circuit in electrical circuit relationship with the power circuit and the lamp for controlling the brightness of the lamp. The control circuit utilizes capacitive means in combination with a current stabilizing means for providing a constant current ballast for the lamp.

The ballast circuit according to the present invention can be used as a dual-level ballast by first applying rated control voltage for bright level and removal of the control voltage to achieve low brightness level. Although the circuit is designed for use with 400 Hz power, which is generally used on aircraft, minor circuit changes also allows the circuit to be utilized at other frequencies including 60-cycle commercial applications.

BRIEF DESCRIPTION OF THE DRAWINGS

FIG. 1 is a schematic diagram of the ballast circuit according to the present invention.

DETAILED DESCRIPTION OF THE ILLUSTRATED EMBODIMENT

The circuit of FIG. 1 provides a control circuit 10 which is coupled to a power circuit 12. Power circuit 12 includes a transformer 14 having a pair of input terminals 16 to which input power is supplied. In an aircraft application, typically the input power is 115 volts, 400 Hz. The secondary of the transformer is connected to a pair of fluorescent lamps 20 and 22. A direct power return leg 15 is provided for current return from the lamps 20 and 22. It is a characteristic of the present invention that the transformer 14 is provided with a gap in the magnetic core, and the purpose of this gap will be explained in greater detail subsequently.

The control circuit 10 includes a pair of input terminals 26 and 28, to which a control voltage is applied. Typically, the control voltage is varied between 0 and 28 volts, 400 Hz, for controlling the brightness of the lamps 20 and 22 connected in the power circuit 12. A zero or minimal input control voltage results in dimming of the lamps 20 and 22 to a very low brightness. Increasing the control voltage to 28 volts causes the lamps 20, 22 to be operated at full rated current and maximum brightness.

An isolation transformer 32 is connected to the input terminals 26, 28 of the control circuit 10, and a rectifier bridge 36 is connected to the output of the transformer 32. The output 34 of rectifier 36 is, in turn, connected to the gate 38 of a power field effect transistor (FET) 40. The circuit is completed by a return through common 68 to the second terminal 35 of the rectifier. The drain-source output 39 of the FET 40 is connected through resistor 72 and a second rectifier bridge 42 to capacitor 44. Capacitor 44, which is connected in series circuit relationship with the voltage step-up winding 46 of the power transformer 14, performs three functions. First, the maximum current in lamps 20 and 22 is determined by capacitor 44 when FET 40 is in a saturated condition. Second, capacitor 44 is a non-dissipative element absorbing excess power across the FET 40 for heat control.

Finally, the combination of the gapped magnetic core of transformer 14 and the capacitor 44 in series circuit relationship with the primary winding 46 of the transformer 14 results in transformer 14 effectively acting as an inductor to balance the capacitive load of the capacitor 44 and thereby provide the desired leading power factor. Selection and adjustment of the electric and magnetic parameters of capacitor 44, transformer 14 and the gap in the core of transformer 14 provide the means for controlling the power factor. Preferably the circuit according to the present invention is operated with a leading power factor.

The field effect transistor 40 acts as a variable resistance which, in combination with resistor 72, appears to the circuit as an infinite inductance element providing constant current to prevent the current in the fluorescent lamps 20 and 22 from rising rapidly as the gas in the fluorescent tubes ionizes and the lamps 20 and 22 are lit. The field effect transistor 40 operating in the active mode is insensitive to voltage fluctuation across the channel thereby providing a constant current in the lamps 20 and 22. As the bias voltage at the gate 38 of the FET 40 increases, the current operating plateau of the FET 40 is raised, resulting in a higher drain current and consequently higher lamp current. For minimum intensity operation, the variable control voltage is set at the lowest setting making the bias voltage at the gate 38 of the FET 40 zero. As the control voltage is increased, the bias voltage at the gate 38 increases, thereby raising the current operating plateau increasing current in the channel of the FET 40 which results in higher lamp current.

The ballast capacitor 44 acts as a series circuit impedance between the transformer 14 and the lamps 20 and 22. Capacitor 44 is chosen so that rated lamp current will flow when maximum control voltage is applied and FET 40 operating in a saturated condition stabilizes and maintains a constant current independent of any difference between required lamp voltage and voltage applied. Based on the value of the capacitor 44 selected, the gap in the core of the transformer 14 is manually adjusted to optimize the power factor as desired.

Zener diode 48 which is connected between the gate 38 and drain source output 39 limits the voltage level above which the FET 40 would be damaged. It thereby protects the FET from destructive transients.

Resistor 58 limits the current flow in control circuit 10 and is chosen so that full brightness will occur at maximum control voltage. The lamps 20 and 22 will always be at minimum brightness sometime before minimum control voltage, thus the extinction point of the lamps 20 and 22 need not be set.

Capacitor 60 filters the voltage from the first rectifier bridge 36 so that a constant voltage over a whole cycle is applied between the gate 38 of the FET 40 and common 68. Capacitor 62 provides a path for bypassing control circuit 10. Capacitor 62 permits a certain minimum amount of current to flow in the lamps even when the circuit 10 is turned "off." The result is a minimum amount of light from the lamps 20 and 22.

Resistor 72 controls channel current in the FET 40. Current in resistor 72 is a result of the difference between signal voltage and control voltage for the FET 40. Negative feedback to FET 40 forces constant current in the circuit once sufficient drain-source voltage is present to move the operation of FET 40 from the cutoff region into the active region.

Resistor 64 discharges capacitor 60 and the capacity of the gate 38 of FET 40 thereby accelerating dimming response.

Resistor 66 isolates the gate 38 of FET 40 from capacitor 60 and prevents oscillations that might occur if capacitor 60 were connected directly to gate 38.

The present invention provides a circuit with equal or improved reliability compared to prior-art magnetic-ballast circuitry in the aircraft industry. The simplicity of the present circuit and the relatively small number of components utilized provide for the high reliability of the present design.

What is claimed is:

1. A ballast circuit for fluorescent lamps comprising:
at least one fluorescent lamp;
a power circuit in electrical circuit relationship with the lamp, the power circuit including a power transformer having a gapped core;
an electronic control circuit electrically connected in series with the power circuit and the lamp for controlling the brightness of the lamp; and
said control circuit utilizing combined capacitive means and continuously variable constant current means for providing ballast for the lamp.

2. A ballast circuit according to claim 1 wherein the control circuit includes a power field effect transistor in electric circuit relationship with the capacitive means such that the field effect transistor acts as a current stabilizer when operating in the current plateau and means for controlling bias voltage to the field effect transistor to variably select the current operating plateau of the field effect transistor.

3. A ballast circuit according to claim 2 wherein the capacitive means is a capacitor coupled to the power transformer.

4. A ballast circuit according to claim 3 wherein the electrical and magnetic parameters of the capacitor, the power transformer and the gapped core are chosen to obtain a predetermined power factor.

5. A ballast circuit according to claim 4 wherein the parameters are chosen so as to produce a leading power factor.

6. A ballast circuit according to claim 4 wherein the parameters are chosen so as to produce a lagging power factor.

7. A ballast circuit according to claim 4 wherein the bias of the field effect transistor is responsive to a continuously variable input voltage to the control circuit for control of the brightness of the lamp.

8. A ballast circuit for fluorescent lamps comprising:
at least one fluorescent lamp;
a power circuit having a gapped core transformer with a primary receiving input power and a secondary connected to the at least one fluorescent lamp;
an electronic control circuit having a capacitor connected to the power transformer primary and connected in series with a continuously variable constant current means having a first bridge receiving current from the capacitor and a field effect transistor connected to the bridge for stabilizing current through the bridge to the at least one fluorescent lamp, the field effect transistor biased to a current plateau thereby allowing constant current control to the lamps insensitive to voltage fluctuations in the power circuit.

9. A ballast circuit for fluorescent lamps as defined in claim 8 further comprising control means for the field effect transistor bias responsive to a continuously variable control voltage.

10. A ballast circuit for fluorescent lamps as defined in claim 9 wherein the control means comprises a variable direct current voltage source connected through an isolation transformer to a second bridge providing current to a gate of the field effect transistor; means for filtering the voltage from the second bridge to the gate; and, means for isolating the filter means from the gate.

11. A ballast circuit for fluorescent lamps as defined in claim 10 wherein the filter means comprises a capacitor and further including means for discharging the capacitor when the control voltage is reduced, thereby accelerating dimming response.

* * * * *